US006148088A

United States Patent [19]

Suzuki et al.

[11] Patent Number: 6,148,088

[45] Date of Patent: Nov. 14, 2000

[54] SPEAKER SYSTEM

[75] Inventors: Seiki Suzuki; Noboru Kyouno, both of Tokyo, Japan

[73] Assignee: Mitsubishi Denki Kabushiki Kaisha, Tokyo, Japan

[21] Appl. No.: 09/148,334

[22] Filed: Sep. 4, 1998

[30] Foreign Application Priority Data

Nov. 11, 1997 [JP] Japan ..... 9-308720

[51] Int. Cl.[7] ..... H04R 25/00

[52] U.S. Cl. ..... 381/345; 381/96; 381/401

[58] Field of Search ..... 381/345, 349, 381/350, 351, 87, 89, 332, 182, 186, 401, 59, 96, 400, FOR 146; 181/144, 145, 147, 156, 199

[56] References Cited

U.S. PATENT DOCUMENTS 3,885,415 5/1975 Fox et al. ..... 381/59
5,197,104 3/1993 Padi ..... 381/401

FOREIGN PATENT DOCUMENTS 56-54195 5/1981 Japan .

OTHER PUBLICATIONS

Watkins et al., Audio, Dec. 1974, pp. 38, 40, 42, 44, 46.

*Primary Examiner*—Huyen Le

[57] ABSTRACT

In a speaker system employing a bass reflex or Kelton type cabinet intends to solve deterioration in efficiency of a speaker caused by an increase in impedance otherwise occurring on both sides of the antiresonance frequency, and to improve the sound radiating efficiency. The speaker system comprises a plurality of dual-voice-coil speaker units (20) which are attached to a bass reflex or Kelton type cabinet (50) and made up of first voice coils (21) connected in parallel to each other with the same polarities joined into one terminal and second voice coils (22) connected in parallel to each other with their same polarities joined into one terminal, and one impedance compensation circuit (10) connected in series to the plurality of second voice coils, which are connected in parallel to each other, for thereby keeping constant the input impedance as a parameter of the speaker system.

7 Claims, 5 Drawing Sheets

SPEAKER SYSTEM

BACKGROUND OF THE INVENTION

1. Field of the Invention

The present invention relates to a speaker system, and more particularly to a speaker system in which a plurality of dual-voice-coil speaker units are attached to a bass reflex or Kelton type cabinet.

2. Description of the Related Art

FIG. 7 shows one example of the arrangement of conventional speakers disclosed by W. H. Watkins, "New Loudspeaker with Extended Bass", Audio, Dec. 1974, pp. 38–46. The disclosed speaker intends to improve the sound radiation efficiency in the bass range by utilizing a dual voice coil. In FIG. 7, denoted by reference numeral 100 is a signal input terminal of the speaker, 20 is a dual-voice-coil speaker unit, 21 is a first voice coil, 22 is a second voice coil, 25 is a bobbin to which the voice coils are attached, and 10 is a compensation circuit for keeping constant the electrical impedance of the speaker. The compensation circuit 10 is constituted by a serial circuit made up of an-inductance L and a capacity C.

Generally, when the compensation circuit 10 is not provided, i.e., when only the first voice coil 21 is used, the electrical impedance of the speaker unit 20 forms a parallel resonance circuit and exhibits a characteristic peak near the lowest resonance frequency $f_0$ of the speaker unit 20, as shown in FIG. 8. Accordingly, a current flowing through the first voice coil 21 is reduced in the vicinity of $f_0$ and the sound radiation efficiency from the speaker is lowered. With these drawbacks in mind, in FIG. 7, the serial circuit made up of the inductance L and the capacity C is connected in series to the second voice coil 22 to provide such an arrangement that a serial resonance circuit including the resistance of the second voice coil 22 as well is connected in parallel to the first voice coil 21, for thereby always keeping constant the electrical impedance of the speaker and improving the sound radiation efficiency.

FIG. 9 shows variations in sound pressure level in the bass range depending on whether the impedance compensation circuit is present or not. As will be seen from FIG. 9, keeping constant the electrical impedance with the compensation circuit raises the sound pressure level in the vicinity of the lowest resonance frequency $f_0$, i.e., increases the sound radiation efficiency. That effect amounts to several dB depending on conditions.

FIG. 10 shows a conventional speaker system which is extended, based on the conventional speaker arrangement shown in FIG. 7, to include a plurality of dual-voice-coil speaker units. In FIG. 10, denoted by 10-1, . . . , 10-i, . . . , 10-n are impedance compensation circuits, 20-1, . . . , 20-i, . . . , 20-n are dual-voice-coil speaker units, 21-1, . . . , 21-i, . . . , 21-n are first voice coils, 22-1, . . . , 22-i, . . . , 22-n are second voice coils, and 25-1, . . . , 25-i, 25-n are bobbins to which the voice coils are attached. Note that the same or equivalent parts as those in FIG. 7 are denoted by the same reference numerals.

Meanwhile, to realize the constant electrical impedance in the conventional speaker arrangement, one impedance compensation circuit is required for one dual-voice-coil speaker unit. In FIG. 10, therefore, the impedance compensation circuits 10-1, . . . , 10-i, . . . , 10-n corresponding to the speaker units 20-1, . . . , 20-i, . . . 20-n are required.

In the conventional speaker system thus constructed, when a plurality of speaker units are used, an impedance compensation circuit is required for each of the speaker units. Accordingly, a plurality of impedance compensation circuits must be provided in a speaker system employing the plurality of speaker units. This has raised problems that the-speaker system is generally expensive and a larger space in a cabinet is occupied by the speaker system; hence a volume necessary for reproducing bass cannot be ensured satisfactorily.

SUMMARY OF THE INVENTION

The present invention has been made with the view of solving the problems as set forth above, and its object is to provide a speaker system employing a bass reflex or Kelton type cabinet wherein even with a plurality of dual-voice-coil speaker units used, the electrical impedance can be kept constant by one impedance compensation circuit.

To achieve the above object, a speaker system of the present invention comprises a bass reflex or Kelton type cabinet, a plurality of dual-voice-coil speaker units each including first and second voice coils, attached to the cabinet and having the same design specifications, and one impedance compensation circuit for keeping constant the electrical impedance as a parameter of the speaker system, the first voice coils being connected in parallel to each other with the same polarities thereof joined into one terminal, the second voice coils being connected in parallel to each other with the same polarities thereof joined into one terminal, the first voice coils being directly applied with an input signal, the second voice coils being applied with an input signal through the impedance compensation circuit.

The present invention also provides a speaker system wherein assuming that circuit elements of the impedance compensation circuit have inductances $L_1$, $L_2$, capacitances $C_1$, $C_2$ and resistances $r_{C1}$, $r_{C2}$, the impedance $Z_C$ of the impedance compensation circuit is expressed by the following formula:

$$Z_C = j\omega L_1 + \frac{1}{j\omega C_1} + \frac{1}{\dfrac{1}{r_{C2} + j\omega L_2} + \dfrac{1}{r_{C1} + \dfrac{1}{j\omega C_2}}}$$

Further, the present invention provides a speaker system wherein assuming that circuit elements of the impedance compensation circuit have inductances $L_1$, $L_2$ and capacitances $C_1$, $C_2$, the impedance $Z_C$ of the impedance compensation circuit is expressed by the following formula:

$$Z_C = j\omega L_1 + \frac{1}{j\omega C_1} + \frac{1}{\dfrac{1}{j\omega L_2} + \dfrac{1}{\dfrac{1}{j\omega C_2}}}$$

Still further, the present invention provides a speaker system wherein assuming that the cabinet is of the bass reflex type, the resonance angular frequency, equivalent mass, compliance, electrical sharpness and mechanical sharpness of each of the dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the air compliance and equivalent mechanical resistance due to the volume of the bass reflex type cabinet looking from one of the speaker units disposed are $C_b$, $r_b$, respectively, the equivalent mass and equivalent mechanical resistance of an acoustic port looking from one of the speaker units disposed are $m_l$, $r_l$, respectively, the impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, the $R_{V2}$ and the element constants of the impedance compensation circuit substantially satisfy the relationships expressed by the following formulae;

$$R_{V2} = R_{V1}\left(\frac{Q_0 Q_m}{Q_m - Q_0}\right)\left\{\frac{1}{Q_0} - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)$$

$$C_2 = \left(\frac{1}{R_{V1}\omega_0}\right)\left(\frac{Q_m - Q_0}{Q_0 Q_m}\right)\left(\frac{\gamma_b}{n}\right)$$

$$r_{C1} = R_{V1}\left(\frac{Q_0 Q_m}{Q_m - Q_0}\right)\left(\frac{n}{Q_b}\right)$$

$$r_{C2} = R_{V1}\left(\frac{Q_0 Q_m}{Q_m - Q_0}\right)\left(\frac{n}{Q_l}\right)$$

where $\beta$, $\delta_b$, $Q_b$ and $Q_l$ are given as follows:

$$\beta = \frac{m_l}{m_0}$$

$$\gamma_b = \frac{C_b}{C_0}$$

$$Q_b = \frac{\omega_0 m_0}{r_b}$$

$$Q_l = \frac{\omega_0 m_0}{r_l}$$

Still further, the present invention provides a speaker system wherein assuming that the cabinet is of the Kelton type having an enclosed air chamber defined behind the speaker units and an air chamber defined in front of the speaker units and acoustically coupled to an acoustic port, the resonance angular frequency, equivalent mass, compliance, electrical sharpness and mechanical sharpness of each of the dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the compliance and equivalent mechanical resistance due to the enclosed air chamber, which is defined behind the speaker units, looking from one of the speaker units disposed are $C_b$, $r_b$, respectively, the compliance and equivalent mechanical resistance due to the air chamber, which is defined in front of the speaker units and acoustically coupled to the acoustic port, looking from one of the speaker units disposed are $C_f$, $r_f$, respectively, the equivalent mass and equivalent mechanical resistance of the acoustic port looking from one of the speaker units disposed are $m_l$, $r_l$, respectively, the impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, the $R_{V2}$ and the element constants of the impedance compensation circuit substantially satisfy the relationships expressed by the following formulae;

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)\frac{\gamma_b}{n + \gamma_b}$$

$$C_2 = \left(\frac{1}{R_{V1}\omega_0}\right)\left(\frac{Q_m - Q_0}{Q_0 Q_m}\right)\left(\frac{\gamma_f}{n}\right)$$

$$r_{C1} = R_{V1}\left(\frac{Q_0 Q_m}{Q_m - Q_0}\right)\frac{n}{Q_f}$$

$$r_{C2} = R_{V1}\left(\frac{Q_0 Q_m}{Q_m - Q_0}\right)\frac{n}{Q_l}$$

where $\beta$, $\delta_b$, $\delta_f$, $Q_b$, $Q_f$ and $Q_l$ are given as follows:

$$\beta = \frac{m_l}{m_0}$$

$$\gamma_b = \frac{C_b}{C_0}$$

$$\gamma_f = \frac{C_f}{C_0}$$

$$Q_b = \frac{\omega_0 m_0}{r_b}$$

$$Q_f = \frac{\omega_0 m_0}{r_f}$$

$$Q_l = \frac{\omega_0 m_0}{r_l}$$

DESCRIPTION OF THE PREFERRED EMBODIMENTS

Several embodiments of the present invention will be described hereunder with reference to the drawings.

Embodiment 1.

Figure 1:
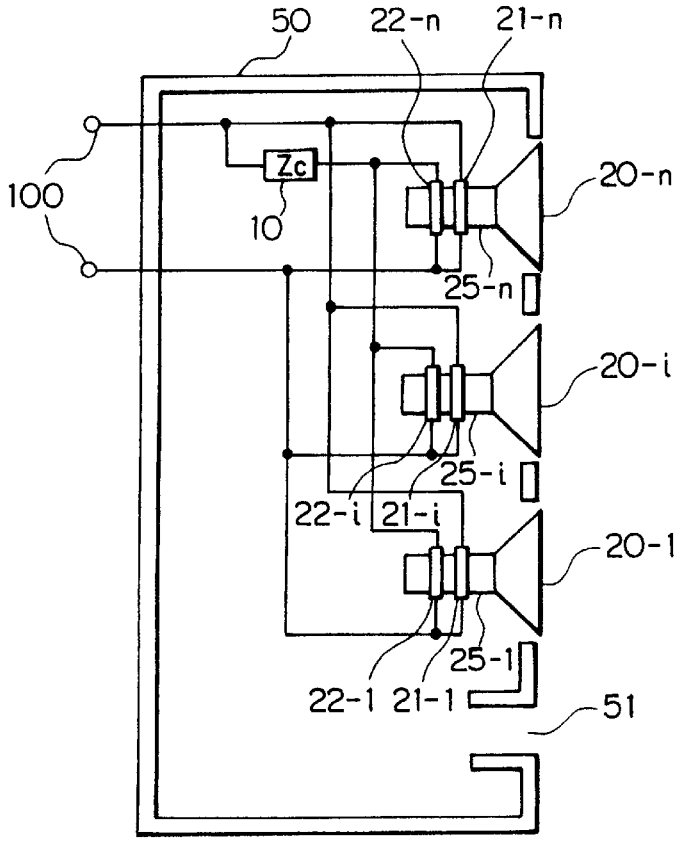
FIG. 1 is a view showing the arrangement of a speaker system according to one embodiment of the present invention.

FIG. 1 is a view showing the arrangement of a speaker system according to one embodiment of the present invention. In FIG. 1, denoted by reference numeral 10 is an impedance compensation circuit for keeping constant the electrical impedance of the speaker, 20-1, . . . , 20-i, . . . , 20-n are dual-voice-coil speaker units all having the same design specification, 21-1, . . . , 21-i, . . . , 21-n are first voice coils, 22-1, . . . , 22-i, . . . , 22-n are second voice coils, 25-1, . . . , 25-i, . . . , 25-n are bobbins to which the voice coils are attached, 50 is a bass reflex type cabinet, 51 an acoustic port, and 100 is a signal input terminal of the speaker.

In the above arrangement, a plurality of dual-voice-coil speaker units are made up such that first voice coils are connected in parallel to each other with the same polarities joined into one terminal and second voice coils are connected in parallel to each other with the same polarities joined into one terminal. Further, the impedance compensation circuit 10 is connected in series to the second voice coils connected in parallel to each other.

The term "bass reflex type cabinet" used herein means a cabinet 50 being of a structure that a space defined behind the plurality of speaker units 20-1, . . . , 20-i, . . . , 20-n installed in the cabinet is acoustically coupled to an acoustic port 51 for radiating sound to the exterior through it.

Figure 2:
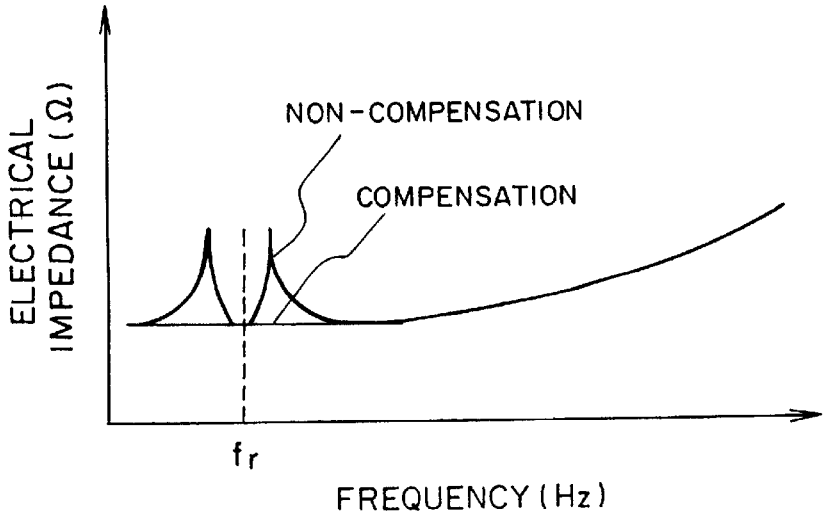
FIG. 2 is a graph showing compared results of an electrical impedance characteristic of a bass reflex speaker system depending on whether a compensation circuit is present or not.

The operation of the speaker system will now be described below with reference to FIGS. 1 and 2. It has hitherto been general that, as shown in FIG. 2, the electrical impedance of the bass reflex type speaker system exhibits two peaks one on each of both sides of the antiresonance frequency. This characteristic represents a result obtained by driving, in the arrangement of FIG. 1, only the first voice coils of the plural speaker units which have the same design specifications and are connected in parallel to each other; i.e., as with the case of using one unit, the total electrical impedance of the speaker units 20-1, . . . , 20-i, . . . , 20-n exhibits two peaks one each of both sides of the antiresonance frequency $f_r$ resulted when driving the plural speaker units. Thus, as the impedance increases, an input current is reduced and the efficiency of radiating sound from the speaker is lowered. To prevent such a lowering of the efficiency, one impedance compensation circuit 10 for keeping constant the electrical impedance as a parameter of the speaker system is connected in series to the second voice coils 22-1, . . . , 22-i, . . . , 22-n of the plural speaker units which are connected in parallel to each other.

Parameter values of the impedance compensation circuit 10 are determined so that the speaker system has the constant electrical impedance when it employs the bass reflex type cabinet. In other words, since the electrical impedance given by only the first voice coils of the plural speaker units, which are connected in parallel to each other, is as plotted in FIG. 2, the parameter values are selected so as to cancel the peaks of the plotted characteristic. The impedance compensation circuit 10 can be indicated by a circuit configuration of FIG. 3 and expressed below in a formula representation.

$$Z_C = j\omega L_1 + \frac{1}{j\omega C_1} + \frac{1}{\dfrac{1}{r_{C2} + j\omega L_2} + \dfrac{1}{r_{C1} + \dfrac{1}{j\omega C_2}}}$$

In the formula (1), resistances $r_{C1}$ and $r_{C2}$ are generally smaller than $j\omega L_2$ and $1/(j\omega C_2)$. Accordingly, approximate replacement of the circuit of FIG. 3 by the circuit of FIG. 4 also provides substantially the same operating effect. The circuit of FIG. 4 can be expressed below in a formula representation.

$$Z_C = j\omega L_1 + \frac{1}{j\omega C_1} + \frac{1}{\dfrac{1}{j\omega L_2} + \dfrac{1}{\dfrac{1}{j\omega C_2}}}$$

Here, although the constants of respective elements of the impedance compensation circuit 10 depend on the number of the dual-voice-coil speaker units employed and the dimensions of the bass reflex type cabinet, conditions required for keeping completely constant the electrical impedance as a parameter of the speaker system are uniquely determined. Assuming that;

- $\omega_0$: resonance angular frequency of the dual-voice-coil speaker unit looking from the first voice coil,
- $m_0$: equivalent mass of the dual-voice-coil speaker unit looking from the first voice coil,
- $C_0$: equivalent mechanical compliance of the dual-voice-coil speaker unit looking from the first voice coil,
- $Q_0$: electrical sharpness of the dual-voice-coil speaker unit looking from the first voice coil,
- $Q_m$: mechanical sharpness of the dual-voice-coil speaker unit looking from the first voice coil,
- $\alpha$: force coefficient ratio of the second voice coil to the first voice coil,
- $C_b$: air compliance due to the volume of the bass reflex type cabinet looking from one of the speaker units disposed,
- $r_b$: equivalent mechanical resistance due to the volume of the bass reflex type cabinet looking from one of the speaker units disposed,
- $m_l$: equivalent mass of the acoustic port looking from one of the speaker units disposed,
- $r_l$: equivalent mechanical resistance of the acoustic port looking from one of the speaker units disposed,
- $R_{V1}$: resistance of the first voice coil,
- $R_{V2}$: resistance of the second voice coil, and
- n: number of the dual-voice-coil speaker units, the resistance $R_{V2}$ of the second voice coil, as well as inductances $L_1$, $L_2$, capacitances $C_1$, $C_2$ and resistances $r_{C1}$, $r_{C2}$ of the elements of the impedance compensation circuit are determined from the following formulae in the case of using the bass reflex type cabinet;

$$R_{V2} = R_{V1}\left(\frac{Q_0 Q_m}{Q_m - Q_0}\right)\left\{\frac{1}{Q_0} - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

-continued $$L_2 = n\left(\frac{R_{VI}}{\omega_0}\right)\left(\frac{Q_0 Q_m}{Q_m - Q_0}\right)\beta$$

$$C_1 = \frac{1}{R_{VI}\omega_0}\left(\frac{Q_m - Q_0}{Q_0 Q_m}\right)$$

$$C_2 = \left(\frac{1}{R_{VI}\omega_0}\right)\left(\frac{Q_m - Q_0}{Q_0 Q_m}\right)\left(\frac{\gamma_b}{n}\right)$$

$$r_{C1} = R_{VI}\left(\frac{Q_0 Q_m}{Q_m - Q_0}\right)\left(\frac{n}{Q_b}\right)$$

$$r_{C2} = R_{VI}\left(\frac{Q_0 Q_m}{Q_m - Q_0}\right)\left(\frac{n}{Q_l}\right)$$

where $\beta$, $\delta_b$, $Q_b$ and $Q_l$ are given as follows:

$$\beta = \frac{m_l}{m_0}$$

$$\gamma_b = \frac{C_b}{C_0}$$

$$Q_b = \frac{\omega_0 m_0}{r_b}$$

$$Q_l = \frac{\omega_0 m_0}{r_l}$$

Figure 5:
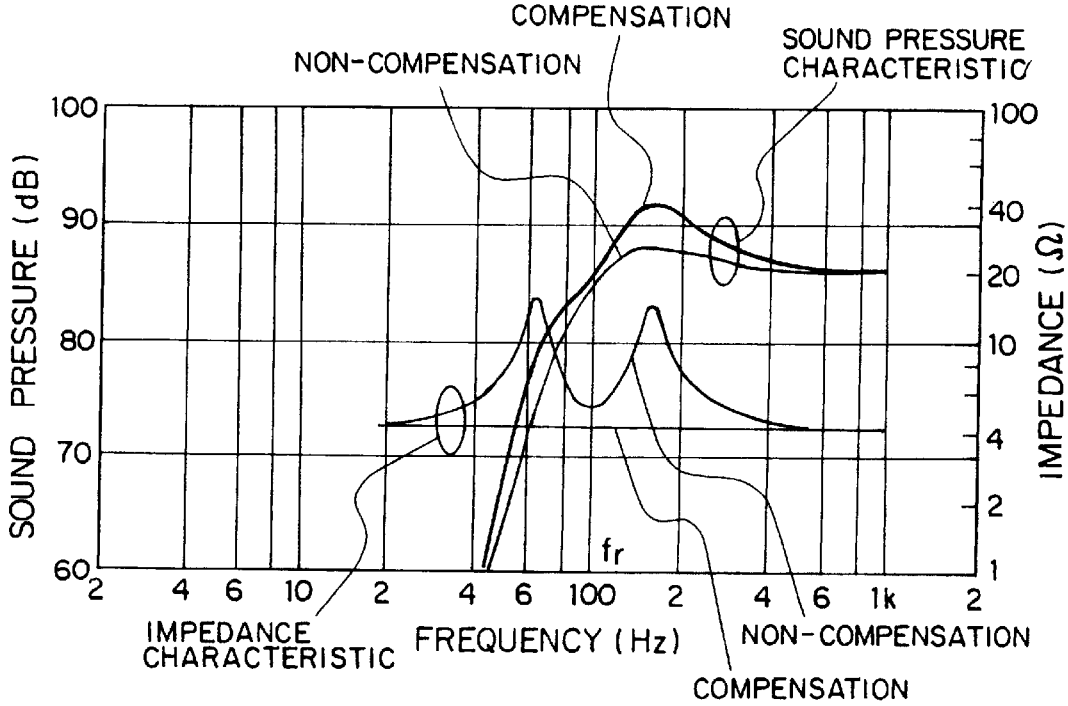
FIG. 5 is a graph showing compared results of variations in a sound pressure characteristic and an electrical impedance characteristic in the bass range depending on whether compensation elements are present or not.

FIG. 5 shows compared results of variations in a sound pressure level characteristic and an electrical impedance characteristic in the bass range depending on whether compensation elements are present or not, the results being calculated when two dual-voice-coil speaker units having the same design specifications are used. As will be seen from FIG. 5, with the provision of the impedance compensation circuit, the electrical impedance is kept constant and the sound pressure level is raised on both sides of the antiresonance frequency $f_r$.

Embodiment 2.

Figure 6:
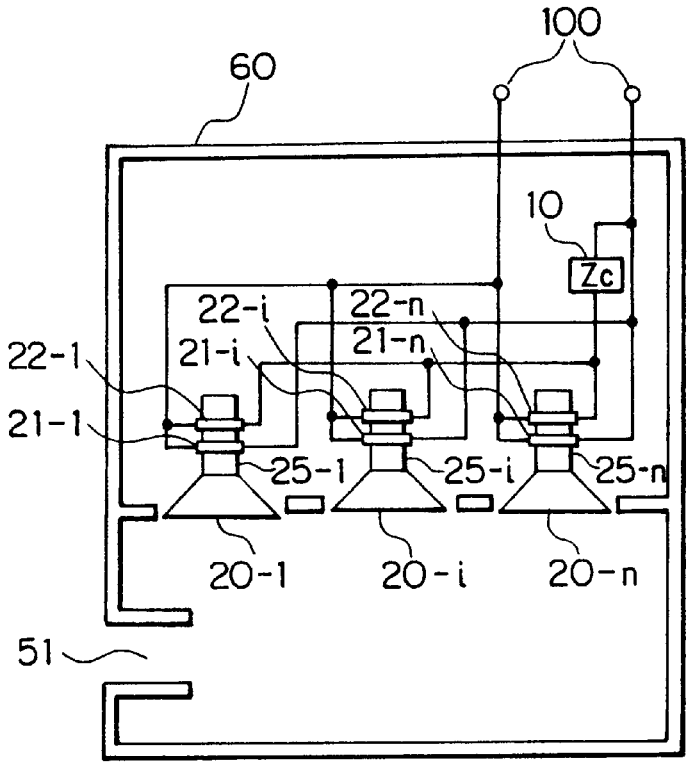
FIG. 6 is a view showing the arrangement of a speaker system according to another embodiment of the present invention.
Figure 7:
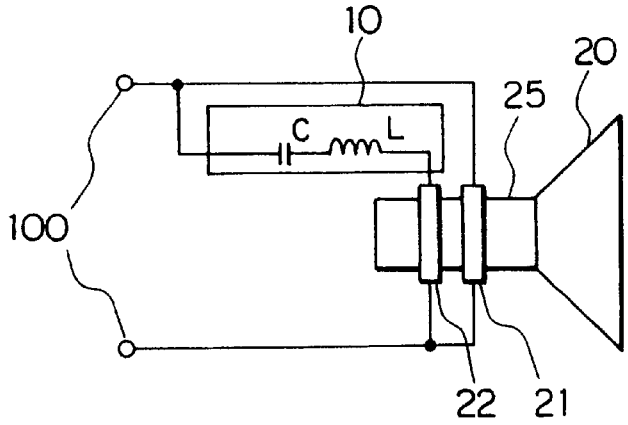
FIG. 7 (PRIOR ART)
FIG. 7 is a view showing the arrangement of a conventional speaker using a dual voice coil.
Figure 8:
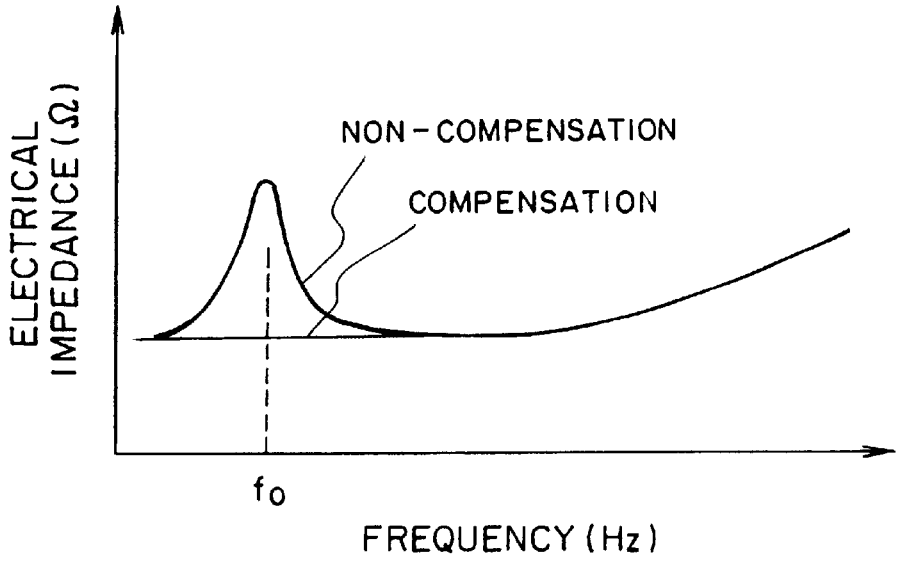
FIG. 8 (PRIOR ART)
FIG. 8 is a graph showing compared results of an electrical impedance characteristic of the conventional speaker using the dual voice coil depending on whether a compensation circuit is present or not.
Figure 9:
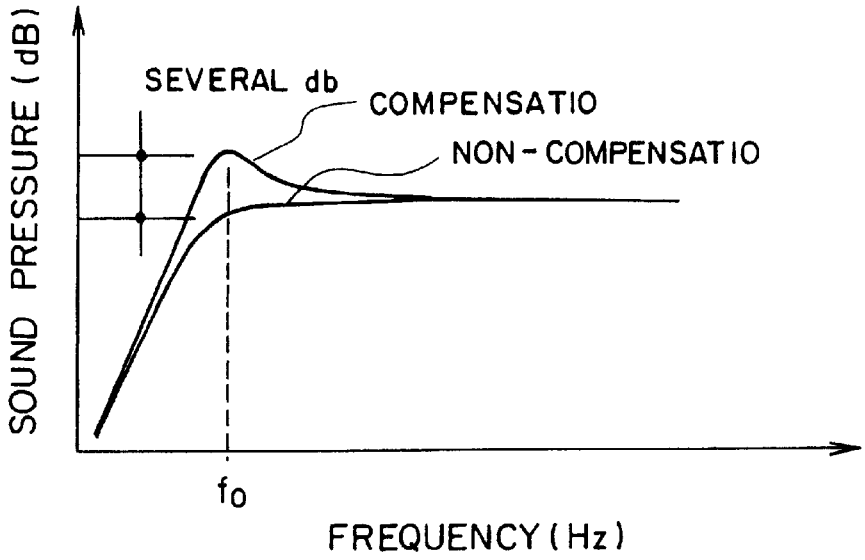
FIG. 9 (PRIOR ART)
FIG. 9 is a graph showing compared results of a sound pressure characteristic of the conventional speaker using the dual voice coil depending on whether the compensation circuit is present or not.
Figure 10:
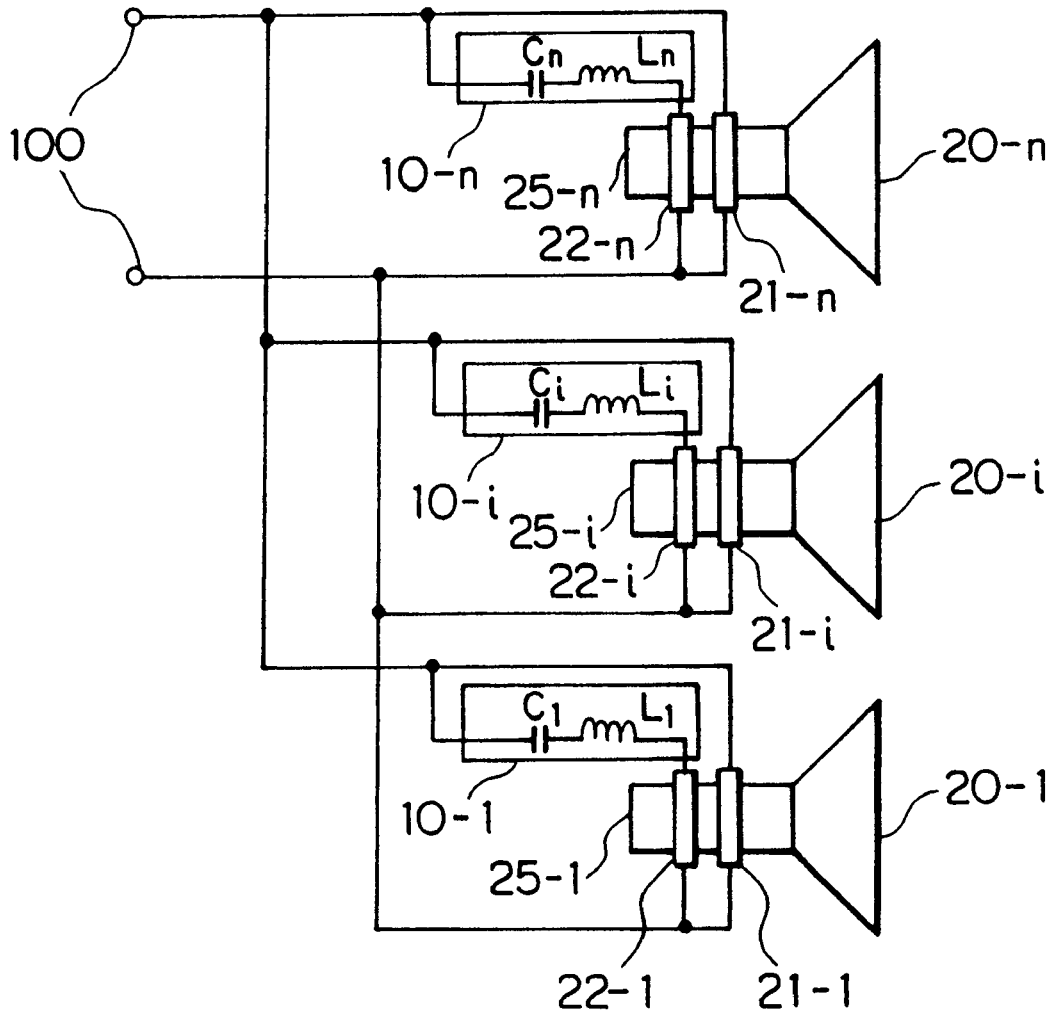
FIG. 10 (PRIOR ART)
FIG. 10 is a view showing the arrangement of a conventional speaker system using a plurality of dual-voice-coil speaker units.

FIG. 6 is a view showing the arrangement of a speaker system according to another embodiment of the present invention. In FIG. 6, denoted by 60 is a Kelton-type cabinet. For the remaining reference-numerals, corresponding parts to those in FIG. 1 are denoted by the same numerals and will not described here in detail.

In FIG. 6, the term "Kelton type cabinet" used herein means a cabinet 60 being of a structure that a space defined behind a plurality of speaker units 20-1, . . . , 20-i, . . . , 20-n installed in the cabinet is closed and a space defined in front of the plurality of speaker units is acoustically coupled to an acoustic port 51 for radiating sound to the exterior through it.

The operation of the speaker system will now be described below. Similarly to the bass reflex type, it has hitherto been general that, as shown in FIG. 2, the electrical impedance of the Kelton type speaker system exhibits two peaks one on each of both sides of the antiresonance frequency. This characteristic represents a result obtained by driving, in the arrangement of FIG. 6, only the first voice coils of the plural speaker units which have the same design specifications and are connected in parallel to each other; i.e., as with the case of using one unit, the total electrical impedance of the speaker units 20-1, . . . , 20-i, . . . , 20-n exhibits two peaks one on each of both sides of the antiresonance frequency fr resulted when driving the plural speaker units. Thus, as the impedance increases, an input current is reduced and the efficiency of radiating sound from the speaker is lowered. To prevent such a lowering of the efficiency, one impedance compensation circuit 10 for keeping constant the electrical impedance as a parameter of the speaker system is connected in series to the second voice coils of the plural speaker units which are connected in parallel to each other.

Parameter values of the impedance compensation circuit 10 are determined so that the speaker system has the constant electrical impedance when it employs the Kelton type cabinet. Similarly to the case of using the bass reflex type cabinet, the impedance compensation circuit 10 can be indicated by a circuit configuration of FIG. 3 and expressed by the same formula as (1).

Figure 3:
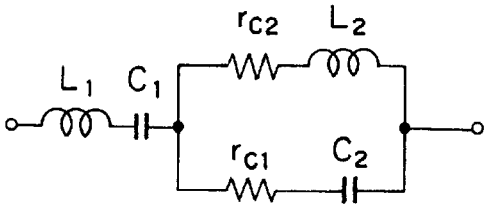
FIG. 3 is a diagram showing one example of a circuit configuration of an impedance compensation circuit according to the present invention.
Figure 4:
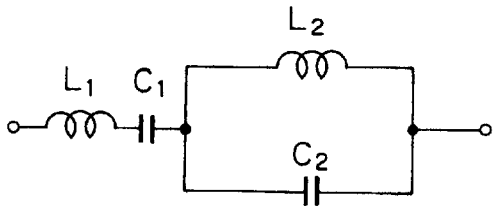
FIG. 4 is a diagram showing another example of the circuit configuration of the impedance compensation circuit according to the present invention.

In the formula (1), resistances $r_{C1}$ and $r_{C2}$ are generally smaller than $j\omega L_2$ and $1/(j\omega C_2)$; hence approximate replacement of the circuit of FIG. 3 by the circuit of FIG. 4 also provides substantially the same operating effect. Accordingly, the circuit of FIG. 4 can also be expressed by the same formula as (2).

Here, although the constants of respective elements of the impedance compensation circuit 10 depend on the number of the dual-voice-coil speaker units employed and the dimensions of the Kelton type cabinet, conditions required for keeping completely constant the electrical impedance as a parameter of the speaker system are uniquely determined. Assuming that;

$\omega_0$: resonance angular frequency of the dual-voice-coil speaker unit looking from the first voice coil, $m_0$: equivalent mass of the dual-voice-coil speaker unit looking from the first voice coil, $C_0$: equivalent mechanical compliance of the dual-voice-coil speaker unit looking from the first voice coil, $Q_0$: electrical sharpness of the dual-voice-coil speaker unit looking from the first voice coil, $Q_m$: mechanical sharpness of the dual-voice-coil speaker unit looking from the first voice coil, $\alpha$: force coefficient ratio of the second voice coil to the first voice coil, $C_b$: air compliance due to the volume of the Kelton type cabinet looking from one of the speaker units disposed, $r_b$: equivalent mechanical resistance due to the volume of the Kelton type cabinet looking from one of the speaker units disposed, $C_f$: equivalent mechanical compliance due to the air chamber in front of the speaker units looking from one of the speaker units disposed, $r_f$: equivalent mechanical resistance due to the air chamber in front of the speaker units looking from one of the speaker units disposed, $m_l$: equivalent mass of the acoustic port looking from one of the speaker units disposed, $r_l$: equivalent mechanical resistance of the acoustic port looking from one of the speaker units disposed, $R_{V1}$: resistance of the first voice coil, $R_{V2}$: resistance of the second voice coil, and n: number of the dual-voice-coil speaker units, the resistance $R_{V2}$ Of the second voice coil, as well as inductances $L_1$, $L_2$, capacitances $C_1$, $C_2$ and resistances $r_{C1}$, $r_{C2}$ of the elements of the impedance compensation circuit are determined from the following formulae in the case of using the Kelton type cabinet;

$$R_{V2} = R_{VI}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\}$$

$$L_1 = \frac{R_{VI}}{\omega_0}\left(\frac{Q_0 Q_m}{Q_m - Q_0}\right)$$

-continued $$L_2 = n\left(\frac{R_{VI}}{\omega_0}\right)\left(\frac{Q_0 Q_m}{Q_m - Q_0}\right)\beta$$

$$C_1 = \frac{1}{R_{VI}\omega_0}\left(\frac{Q_m - Q_0}{Q_0 Q_m}\right)\frac{\gamma_b}{n + \gamma_b}$$

$$C_2 = \left(\frac{1}{R_{VI}\omega_0}\right)\left(\frac{Q_m - Q_0}{Q_0 Q_m}\right)\left(\frac{\gamma_f}{n}\right)$$

$$r_{C1} = R_{VI}\left(\frac{Q_0 Q_m}{Q_m - Q_0}\right)\frac{n}{Q_f}$$

$$r_{C2} = R_{VI}\left(\frac{Q_0 Q_m}{Q_m - Q_0}\right)\frac{n}{Q_l}$$

where $\beta$, $\delta_b$, $\delta_f$, $Q_b$, $Q_f$ and $Q_l$ are given as follows:

$$\beta = \frac{m_l}{m_0}$$

$$\gamma_b = \frac{C_b}{C_0}$$

$$\gamma_f = \frac{C_f}{C_0}$$

$$Q_b = \frac{\omega_0 m_0}{r_b}$$

$$Q_f = \frac{\omega_0 m_0}{r_f}$$

$$Q_l = \frac{\omega_0 m_0}{r_l}$$

According to the present invention, as described above, the speaker system comprises a bass reflex or Kelton type cabinet, a plurality of dual-voice-coil speaker units each including first and second voice coils, attached to the cabinet and having the same design specifications, and one impedance compensation circuit for keeping constant the electrical impedance as a parameter of the speaker system, the first voice coils being connected in parallel to each other with the same polarities thereof joined into one terminal, the second voice coils being connected in parallel to each other with the same polarities joined into one terminal, the first voice coils being directly applied with an input signal, the second voice coils being applied with an input signal through the impedance compensation circuit. Therefore, the input supplied to the speaker system can be always kept constant and the sound radiation efficiency can be improved on both sides of the antiresonance frequency of the speaker system including the bass reflex or Kelton type cabinet. Other advantages are that the speaker system can be constructed inexpensively in spite of a plurality of speaker units being used, and a volume necessary for reproducing bass can be ensured sufficiently.

Also, assuming that the circuit elements of the impedance compensation circuit have inductances $L_1$, $L_2$, capacitances $C_1$, $C_2$ and resistances $r_{C1}$, $r_{C2}$, the impedance $Z_C$ of the impedance compensation circuit is set as being expressed by the above formula (1). This feature enables the impedance compensation circuit to be specified in practical design.

Further, assuming that the circuit elements of the impedance compensation circuit have inductances $L_1$, $L_2$ and capacitances $C_1$, $C_2$, the impedance $Z_C$ of the impedance compensation circuit is set as being expressed by the above formula (2). Therefore, the impedance compensation circuit can be replaced by a simpler approximate circuit and the above advantage can be more simply realized.

Moreover, assuming that the cabinet is of the bass reflex type, the resonance angular frequency, equivalent mass, compliance, electrical sharpness and mechanical sharpness of each of the dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the air compliance and equivalent mechanical resistance due to the volume of the bass reflex type cabinet looking from one of the speaker units disposed are $C_b$, $r_b$, respectively, the equivalent mass and equivalent mechanical resistance of an acoustic port looking from one of the speaker units disposed are $m_l$, $r_l$, respectively, the impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, the $R_{V2}$ and the element constants of the impedance compensation circuit substantially satisfy the relationships expressed by the above formulae (3) to (13). Therefore, the above-mentioned advantages can be achieved in the speaker system including the bass reflex type cabinet.

In addition, assuming that the cabinet is of the Kelton type having an enclosed air chamber defined behind the speaker units and an air chamber defined in front of the speaker units and acoustically coupled to an acoustic port, the resonance angular frequency, equivalent mass, compliance, electrical sharpness and mechanical sharpness of each of the dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the compliance and equivalent mechanical resistance due to the enclosed air chamber, which is defined behind the speaker units, looking from one of the speaker units disposed are $C_b$, $r_b$, respectively, the compliance and equivalent mechanical resistance due to the air chamber, which is defined in front of the speaker units and acoustically coupled to the acoustic port, looking from one of the speaker units disposed are $C_f$, $r_f$, respectively, the equivalent mass and equivalent mechanical resistance of the acoustic port looking from one of the speaker units disposed are $m_l$, $r_l$, respectively, the impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, the $R_{V2}$ and the element constants of the impedance compensation circuit substantially satisfy the relationships expressed by the above formulae (14) to (26). Therefore, the above-mentioned advantages can be achieved in the speaker system including the Kelton type cabinet.

What is claimed is:

1. A speaker system comprising:

a bass reflex or Kelton type cabinet, a plurality of dual-voice-coil speaker units each including first and second voice coils, attached to said cabinet and having the same specifications, and one impedance compensation circuit for keeping constant the electrical impedance as a parameter of said speaker system, said first voice coils being connected in parallel to each other with the same polarities thereof joined into one terminal, said second voice coils being connected in parallel to each other with the same polarities joined into one terminal, said first voice coils being directly applied with an input signal, said second voice coils being applied with an input signal through said impedance compensation circuit.

2. The speaker system according to claim 1, wherein assuming that circuit elements of said impedance compensation circuit have inductances $L_1$, $L_1$, capacitances $C_1$, $C_2$ and resistances $r_{C1}$, $r_{C2}$, the impedance $Z_C$ of said impedance compensation circuit is expressed by the following formula:

$$Z_C = j\omega L_1 + \frac{1}{j\omega C_1} + \frac{1}{\frac{1}{r_{C2} + j\omega L_2} + \frac{1}{r_{C1} + \frac{1}{j\omega C_2}}}.$$

3. The speaker system according to claim 2, wherein assuming that said cabinet is of the bass reflex type, the resonance angular frequency, equivalent mass, compliance, electrical sharpness and mechanical sharpness of each of said dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the air compliance and equivalent mechanical resistance due to the volume of said bass reflex type cabinet looking from one of said speaker units disposed are $C_b$, $r_b$, respectively, the equivalent mass and equivalent mechanical resistance of an acoustic port looking from one of said speaker units disposed are $m_l$, $r_l$, respectively, said impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, said $R_{V2}$ and said element constants of said impedance compensation circuit substantially satisfy the relationships expressed by the following formulae;

$$R_{V2} = R_{V1}\left(\frac{Q_0 Q_m}{Q_m - Q_0}\right)\left\{\frac{1}{Q_0} - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)$$

$$C_2 = \left(\frac{1}{R_{V1}\omega_0}\right)\left(\frac{Q_m - Q_0}{Q_0 Q_m}\right)\left(\frac{\gamma_b}{n}\right)$$

$$r_{C1} = R_{V1}\left(\frac{Q_0 Q_m}{Q_m - Q_0}\right)\left(\frac{n}{Q_b}\right)$$

$$r_{C2} = R_{V1}\left(\frac{Q_0 Q_m}{Q_m - Q_0}\right)\left(\frac{n}{Q_l}\right)$$

where $\beta$, $\delta_b$, $Q_b$ and $Q_l$ are given as follows:

$$\beta = \frac{m_l}{m_0}$$

$$\gamma_b = \frac{C_b}{C_0}$$

$$Q_b = \frac{\omega_0 m_0}{r_b}$$

$$Q_l = \frac{\omega_0 m_0}{r_l}.$$

4. The speaker system according to claim 2, wherein assuming that said cabinet is of the Kelton type having an enclosed air chamber defined behind said speaker units and an air chamber defined in front of said speaker units and acoustically coupled to an acoustic port, the resonance angular frequency, equivalent mass, compliance, electrical sharpness and mechanical sharpness of each of said dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the compliance and equivalent mechanical resistance due to said enclosed air chamber, which is defined behind said speaker units, looking from one of said speaker units disposed are $C_b$, $r_b$, respectively, the compliance and equivalent mechanical resistance due to said air chamber, which is defined in front of said speaker units and acoustically coupled to said acoustic port, looking from one of said speaker units disposed are $C_f$, $r_f$, respectively, the equivalent mass and equivalent mechanical resistance of said acoustic port looking from one of the speaker units disposed are $m_l$, $r_l$, respectively, said impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, said $R_{V2}$ and said element constants of said impedance compensation circuit substantially satisfy the relationships expressed by the following formulae;

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)\frac{\gamma_b}{n + \gamma_b}$$

$$C_2 = \left(\frac{1}{R_{V1}\omega_0}\right)\left(\frac{Q_m - Q_0}{Q_0 Q_m}\right)\left(\frac{\gamma_f}{n}\right)$$

$$r_{C1} = R_{V1}\left(\frac{Q_0 Q_m}{Q_m - Q_0}\right)\frac{n}{Q_f}$$

$$r_{C2} = R_{V1}\left(\frac{Q_0 Q_m}{Q_m - Q_0}\right)\frac{n}{Q_l}$$

where $\beta$, $\delta_b$, $\delta_f$, $Q_b$, $Q_f$ and $Q_l$ are given as follows:

$$\beta = \frac{m_l}{m_0}$$

$$\gamma_b = \frac{C_b}{C_0}$$

$$\gamma_f = \frac{C_f}{C_0}$$

$$Q_b = \frac{\omega_0 m_0}{r_b}$$

$$Q_f = \frac{\omega_0 m_0}{r_f}$$

$$Q_l = \frac{\omega_0 m_0}{r_l}.$$

5. The speaker system according to claim 1, wherein assuming that circuit elements of said impedance compensation circuit have inductances $L_1$, $L_2$ and capacitances $C_1$, $C_2$, the impedance $Z_C$ of said impedance compensation circuit is expressed by the following formula:

$$Z_C = j\omega L_1 + \frac{1}{j\omega C_1} + \frac{1}{\frac{1}{j\omega L_2} + \frac{1}{\frac{1}{j\omega C_2}}}.$$

6. The speaker system according to claim 5, wherein assuming that said cabinet is of the bass reflex type, the resonance angular frequency, equivalent mass, compliance, electrical sharpness and mechanical sharpness of each of said dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the air compliance and equivalent mechanical resistance due to the volume of said bass reflex type cabinet looking from one of said speaker units disposed are $C_b$, $r_b$, respectively, the equivalent mass and equivalent mechanical resistance of an acoustic port looking from one of said speaker units disposed are $m_l$, $r_l$, respectively, said impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, said $R_{V2}$ and said element constants of said impedance compensation circuit substantially satisfy the relationships expressed by the following formulae;

$$R_{V2} = R_{V1}\left(\frac{Q_0 Q_m}{Q_m - Q_0}\right)\left\{\frac{1}{Q_0} - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)$$

$$C_2 = \left(\frac{1}{R_{V1}\omega_0}\right)\left(\frac{Q_m - Q_0}{Q_0 Q_m}\right)\left(\frac{\gamma_b}{n}\right)$$

$$r_{C1} = R_{V1}\left(\frac{Q_0 Q_m}{Q_m - Q_0}\right)\left(\frac{n}{Q_b}\right)$$

$$r_{C2} = R_{V1}\left(\frac{Q_0 Q_m}{Q_m - Q_0}\right)\left(\frac{n}{Q_l}\right)$$

where $\beta$, $\delta_b$, $Q_b$ and $Q_l$ are given as follows:

$$\beta = \frac{m_l}{m_0}$$

$$\gamma_b = \frac{C_b}{C_0}$$

$$Q_b = \frac{\omega_0 m_0}{r_b}$$

$$Q_l = \frac{\omega_0 m_0}{r_l}.$$

7. The speaker system according to claim 5, wherein assuming that said cabinet is of the Kelton type having an enclosed air chamber defined behind said speaker units and an air chamber defined in front of said speaker units and acoustically coupled to an acoustic port, the resonance angular frequency, equivalent mass, compliance, electrical sharpness and mechanical sharpness of each of said dual-voice-coil speaker units looking from the first voice coil are respectively $\omega_0$, $m_0$, $C_0$, $Q_0$ and $Q_m$ on condition of the second voice coil being made open, the force coefficient ratio of the second voice coil to the first voice coil is $\alpha$, the number of the dual-voice-coil speaker units employed is n, the compliance and equivalent mechanical resistance due to said enclosed air chamber, which is defined behind said speaker units, looking from one of said speaker units disposed are $C_b$, $r_b$, respectively, the compliance and equivalent mechanical resistance due to said air chamber, which is defined in front of said speaker units and acoustically coupled to said acoustic port, looking from one of said speaker units disposed are $C_f$, $r_f$, respectively, the equivalent mass and equivalent mechanical resistance of said acoustic port looking from one of the speaker units disposed are $m_l$, $r_l$, respectively, said impedance compensation circuit has inductances $L_1$, $L_2$, capacitances $C_1$, $C_2$ and resistances $r_{C1}$, $r_{C2}$, and the resistances of the first and second voice coils are $R_{V1}$, $R_{V2}$, respectively, said $R_{V2}$ and said element constants of said impedance compensation circuit substantially satisfy the relationships expressed by the following formulae;

$$R_{V2} = R_{V1}\left(\frac{Q_0 Q_m}{Q_m - Q_0}\right)\left\{\left(\frac{1}{Q_0} + \frac{n}{Q_b}\right) - 2\alpha\left(\frac{Q_m - Q_0}{Q_m Q_0}\right)\right\}$$

$$L_1 = \frac{R_{V1}}{\omega_0}\left(\frac{Q_0 Q_m}{Q_m - Q_0}\right)$$

$$L_2 = n\left(\frac{R_{V1}}{\omega_0}\right)\left(\frac{Q_0 Q_m}{Q_m - Q_0}\right)\beta$$

$$C_1 = \frac{1}{R_{V1}\omega_0}\left(\frac{Q_m - Q_0}{Q_0 Q_m}\right)\frac{\gamma_b}{n + \gamma_b}$$

$$C_2 = \left(\frac{1}{R_{V1}\omega_0}\right)\left(\frac{Q_m - Q_0}{Q_0 Q_m}\right)\left(\frac{\gamma_f}{n}\right)$$

$$r_{C1} = R_{V1}\left(\frac{Q_0 Q_m}{Q_m - Q_0}\right)\frac{n}{Q_f}$$

$$r_{C2} = R_{V1}\left(\frac{Q_0 Q_m}{Q_m - Q_0}\right)\frac{n}{Q_l}$$

where $\beta$, $\delta_b$, $\delta_f$, $Q_b$, $Q_f$ and $Q_l$ are given as follows:

$$\beta = \frac{m_l}{m_0}$$

$$\gamma_b = \frac{C_b}{C_0}$$

$$\gamma_f = \frac{C_f}{C_0}$$

$$Q_b = \frac{\omega_0 m_0}{r_b}$$

$$Q_f = \frac{\omega_0 m_0}{r_f}$$

$$Q_l = \frac{\omega_0 m_0}{r_l}.$$

* * * * *